United States Patent [19]

Carmody et al.

[11] Patent Number: 4,457,376

[45] Date of Patent: Jul. 3, 1984

[54] FLAPPER TYPE SAFETY VALVE FOR SUBTERRANEAN WELLS

[75] Inventors: Michael A. Carmody, Broken Arrow; Michael L. Cognevich, Tulsa, both of Okla.

[73] Assignee: Baker Oil Tools, Inc., Orange, Calif.

[21] Appl. No.: 378,925

[22] Filed: May 17, 1982

[51] Int. Cl.[3] ..... E21B 34/14

[52] U.S. Cl. ..... 166/332; 251/298

[58] Field of Search ..... 166/332, 334, 324, 331, 166/325; 251/298, 349

[56] References Cited

U.S. PATENT DOCUMENTS

| | | | |
|---|---|---|---|
| 2,162,578 | 6/1939 | Hacker | 166/325 X |
| 3,071,151 | 1/1963 | Sizer | 166/324 X |
| 3,249,124 | 5/1966 | Berryman | 166/331 X |
| 3,726,341 | 4/1973 | Holbert | 166/321 |
| 3,845,818 | 11/1974 | Deaton | 166/324 X |
| 4,325,431 | 4/1982 | Akkerman | 166/321 X |

*Primary Examiner*—Stephen J. Novosad
*Assistant Examiner*—Michael Starinsky
*Attorney, Agent, or Firm*—Norvell & Associates

[57] ABSTRACT

The disclosure relates to an improved flapper type saftey valve and valve housing for use in subterranean wells wherein the flapper valve is actuated from a horizontal closed position to a vertical open position by contact with a downwardly moving actuating sleeve. The top surface of the valve is elevated so that the bottom edge of the actuating sleeve always contacts the flapper valve at a position spaced from the axis of the pivot mounting, thereby assuring that the opening force applied to the flapper valve has a maximum moment arm in order to overcome any fluid pressure differential existing across the flapper valve. The valve is mounted in an eccentric bore on an eccentric mounting base and fully opened flapper valve provides maximum flow area through the valve.

17 Claims, 4 Drawing Figures

FLAPPER TYPE SAFETY VALVE FOR SUBTERRANEAN WELLS

BACKGROUND OF THE INVENTION

1. Field of the Invention

The invention relates to a safety valve for a subterranean well of the type employing a pivotally movable flapper which cooperates with an annular valve seat defined on a well conduit.

2. Description of the Prior Art

Flapper type safety valves have long been employed in subterranean wells. One of the common forms of actuating mechanisms for such flapper valve is an actuating sleeve having a piston shoulder formed thereon upon which fluid pressure is imposed to drive the sleeve downwardly and thus pivot the flapper valve from a transverse, closed position to a vertical, open position. Due to the accumulation of tolerances involved in the assemblage of the flapper valve and the actuating sleeve to the well conduit, it often happens that the actuating sleeve engages the upper surface of the flapper valve at a point that is closely proximate to the pivot mounting axis of the flapper valve. In many cases, the well pressure below the flapper valve is in excess of the fluid pressure existing above the valve so a substantial fluid pressure differential exists across the flapper valve opposing its movement. If the actuating sleeve only contacts the flapper valve at a region close to its pivotal axis, it is obvious that a substantially greater force must be applied by the sleeve to the flapper valve to effect its opening.

In addition to the high opening forces which can be created by a pressure differential from below a flapper valve, problems can also arise as the flapper valve closes under large pressure differentials. Damage can result when the flapper valve, moving rapidly under the influence of large pressure differentials, strikes the stationary valve seat. Damage to the flapper valve, to the valve seat and to the hinge pin can seriously affect the performance of a flapper type safety valve.

In prior art flapper valves, such as that shown in U.S. Pat. No. 3,375,874, protrusions extending from the outer edges of the upper surface have been used to establish initial contact between the flapper valve and a flow actuating tube at a location spaced from the hinge or pivot of the valve. These spaced protrusions have served to increase the moment acting on the flapper valve in opposition to pressure differentials below the valve. These protrusions can, however, create space problems when the valve is open and the actuating sleeve extends past the protrusions and can reduce the flow area available through the valve when a flapper valve having a flap upper surface is used.

One means of providing additional space to permit full opening of the flapper valve is to utilize an eccentric housing. For example the safety valve shown in U.S. Pat. No. 3,726,341 employs an eccentric housing used with a flapper having a laterally offset pivot or axle means.

One other means of solving this space problem is disclosed in U.S. patent application Ser. No. 280,039 filed July 6, 1981. This flapper valve configuration is equivalent to a section cut through a tubular member about an axis normal to the axis of the tubular member.

The flapper valve disclosed and claimed herein combines a structure adapted to overcome the problems arising from large pressure differentials existing below the valve and the dimensional constraints required for a valve with the largest possible flow area. The configuration of the valve and the flapper components also results in a high degree of strength for the operating mechanism so that the valve can be used in the presence of large forces.

SUMMARY OF THE INVENTION

In accordance with this invention, a flapper valve is pivotally mounted to one side of a tubular conduit and is provided with an annular sealing surface that cooperates with a downwardly facing, conical segment sealing surface formed on the well conduit. An actuating sleeve is vertically reciprocable in the tubular conduit and downward movement of the sleeve will effect its engagement with the upper surface of the flapper valve to apply downward opening force to the flapper valve. In accordance with this invention an inclined elevated upper surface of the flapper valve insures that the actuating sleeve will contact the flapper valve at a position remote from the pivotal axis of the flapper valve. Additionally, the elevated surface of the flapper is provided with a cylindrical segment recess of substantially the same diameter as the exterior diameter of the actuating sleeve and disposed relative to the pivotal axis of the flapper so as to snugly conform to the actuating sleeve when the flapper valve is shifted to its fully open, vertical position. The recess minimizes the interference between the flapper valve and the actuating sleeve in the open position and increases the available flow area.

The flapper is pivotally mounted on the eccentric flange of a flapper base which can be transversely inserted through the concentric bore of the valve housing. The base, with flapper attached, can be rotated in the eccentric bore in the valve housing. A cylindrical support member can then be attached to the housing and this support secures the flapper, the flapper base, and the valve seat in position.

Further objects and advantages of the invention will be readily apparent to those skilled in the art from the following detailed description, taken in conjunction with the annexed sheet of drawings on which is shown a preferred example of the invention.

BREIF DESCRIPTION OF THE DRAWINGS

DESCRIPTION OF THE PREFERRED EMBODIMENT

Figure 1:
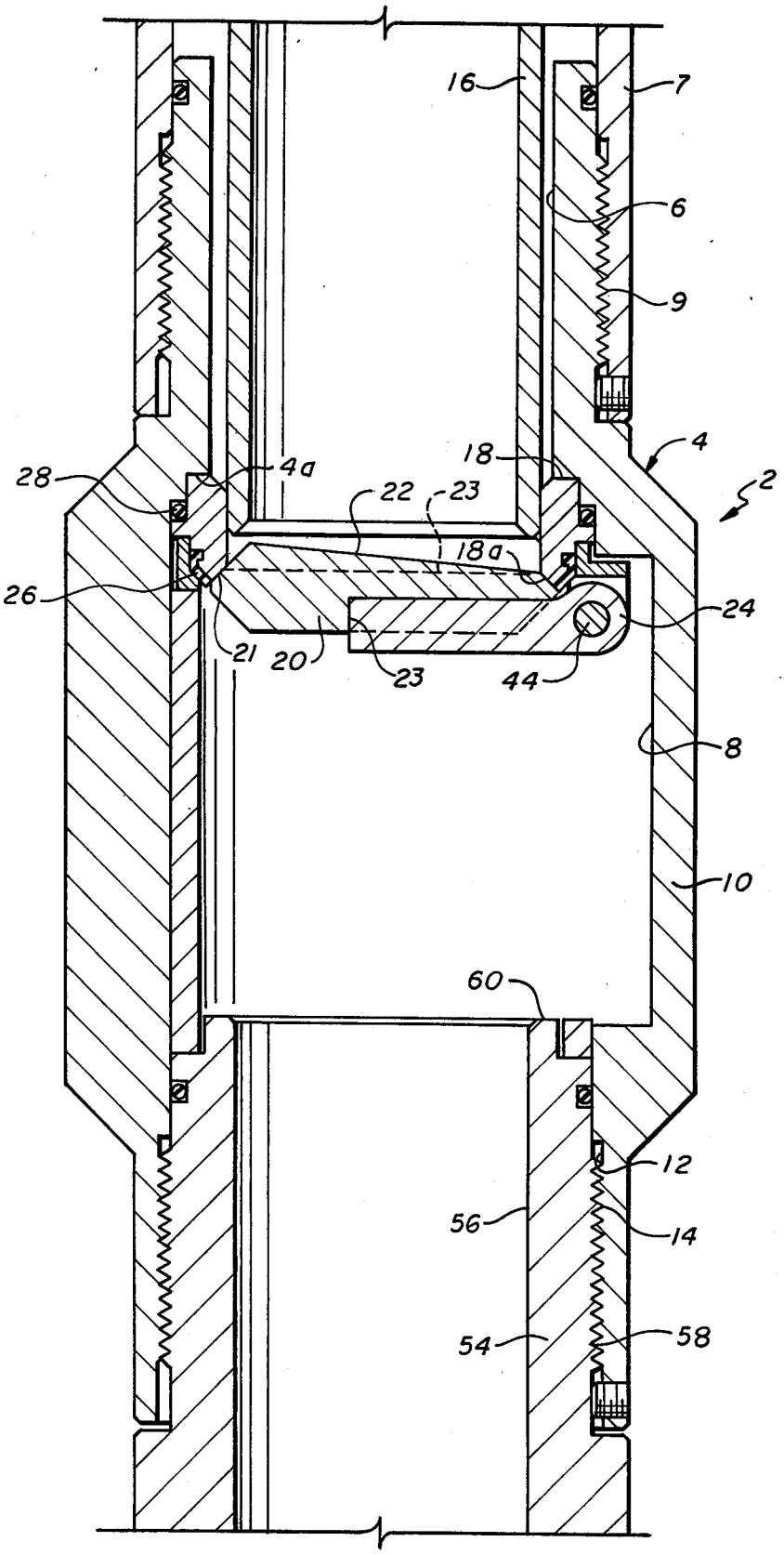
FIG. 1 is a longitudinal cross-section of the flapper type valve showing the flapper in the closed position.

Referring to the drawings, there is shown a portion of a safety valve 2 having an eccentric bore housing member 4 and incorporating the flapper actuating mechanism embodied in this invention. The valve housing 4 has an upper concentric bore 6 and an intermediate inner eccentric bore 8 contained within the eccentric housing section 10. The external diameter of the eccentric housing section 10 is greater than the external diameter of the tubular conduit 7 which comprises the upper housing of the safety valve and is attached to flapper housing 4 by means of threaded connections 9.

A longitudinally reciprocal cylindrical actuating sleeve 16 is located on the interior of housing 4 and extends concentrically within housing bore 6. Actuating sleeve 16 extends upwardly within a conventional valve upper housing, which is not shown herein. This upper housing can comprise a spring member urging the actuating sleeve upward and a control fluid pressure chamber acting on an appropriate surface on sleeve 16 to urge this actuating member downward. This configuration is conventional, and tubing mounted or wireline downhole safety valves actuated by means of an external control fluid pressure line are quite common.

The lower portion of valve housing 4 comprises a section having an internal bore 12 which is concentric and has a larger internal diameter than the upper concentric bore 6. Conventional threads 14 extend along the inner surface of the lower section of the valve housing 4.

A circular flapper valve 20 is shown in its horizontal closed position in FIG. 1. On the upper surface of flapper 20, the outer or peripheral annular conical sealing surface is configured to sealingly engage a conical valve seat 32 and its companion annular elastomeric seal 26. The flapper 20 is provided with integral hinge portions 24 which receive a pivot pin 44 to pivotally mounting the flapper 20 within eccentric bore 8. A torsion spring (not shown) is conventionally wrapped around pivot pin 44 to exert an upward pivotal bias on flapper 20 urging it to its closed, sealed position.

As is well known to those skilled in the art, the flapper 20 may be moved to its open position through the downward movement of actuating sleeve 16. Forcible downward movement of the actuating sleeve 16 will overcome overcome the bias of the torsion spring acting on the flapper 20 and substantial fluid pressure differentials in the order of several hundred pounds per square inch acting to keep the valve in a closed position. The flapper will thus be rotated downwardly to a substantially vertical open position illustrated in FIG. 2. In order to assure that the bottom edge of actuating sleeve 16 always contacts the flapper 20 at a position maximumly spaced from the axis of the pivot pin 44, flapper valve 20 is provided with an elevated top surface 22 which in this embodiment comprises a planar surface sloping upwardly and away from the aixs of pivot mounting pin 44 at an angle of approximately 5°. With this configuration, the bottom edge portions of the actuating sleeve 16 that are spaced away from the axis of the pivot mounting pin 44 will provide the first contact with the flapper 20 at a position providing essentially the maximum possible moment arm about the pivotal axis of the flapper mechanism. The actuating sleeve will initially strike the annular conical sealing surface 21. Because of the elevation of surface 22, the initial points of contact will lie above the cooperable sealing surface of the valve seat and will be spaced from the hinge. Thus, the flapper valve 20 may be opened even though a substantial fluid pressure differential exists across the valve, without incurring the risk of damaging the flapper 20, its pivot mounting pin 44, or the actuating sleeve 16.

When the flapper closes in the presence of a substantial fluid pressure differential, which can result in rapid closure of the flapper because of the large forces acting on it, the flapper will initially strike the actuating sleeve 16 rather than the valve seat 32. The actuating sleeve which is urged downward by fluid pressure will serve to damp the movement of the flapper as the flapper valve exerts a force in the upward direction. During closure, the actuating sleeve will engage the conical sealing surface 21 at a point adjacent the hinge 24, and as the flapper closes will progressively engage the conical sealing surface 21 around the remainder of the upper circumference of the flapper.

Figure 2:
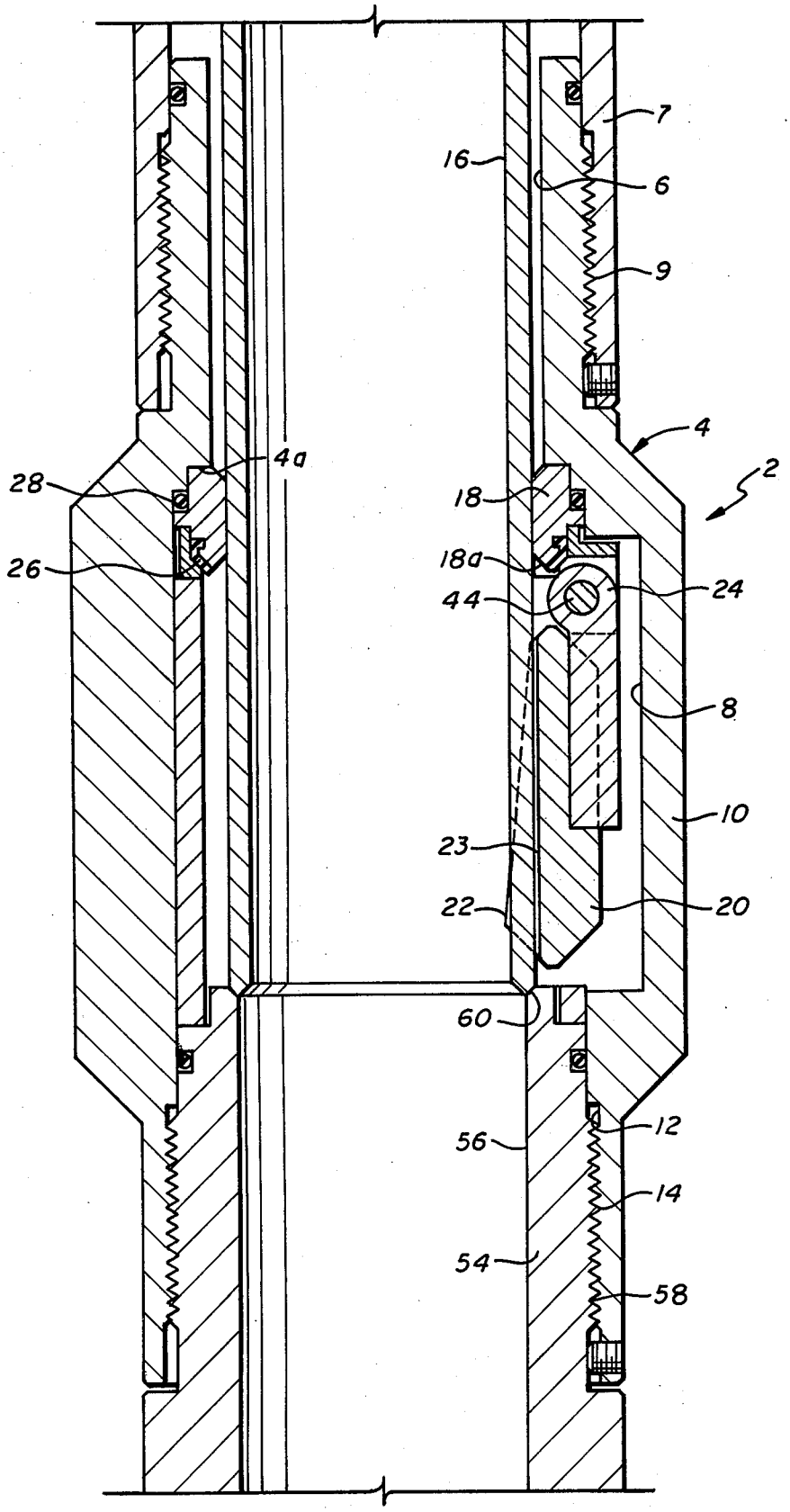
FIG. 2 is a view similar to FIG. 1 but showing the flapper in the open position.

The elevated surface 22 is further provided with an arcuate, cylindrical segment recess 23. Recess 23 has a curvature corresponding to the external diameter of the actuating sleeve 16 so that it snugly conforms to the actuating sleeve 30 when the flapper lies in its fully open, vertical position, as illustrated in FIG. 2. Recess 23 permits complete opening of the flapper without reducing the flow area through actuating sleeve 30 and through the valve itself or without unduly increasing the size or reducing the thickness of valve housing 4. Recess 23 not only extends through the elevated upper surface 22 but also extends through the conical sealing surface 21 adjacent the exterior of the flapper. The intersection of the sealing surface 21 with inclined elevated surface 22 on opposite sides of recess 23 thus defines the two uppermost extensions of the flapper valve 20. It is at these two points, spaced from hinge 24 and from the axis of the valve where resultant pressure forces will act, that the actuating sleeve will initially contact to open flapper valve 20. Adequate sealing area will still exist on surface 21 below recess 23 to fully contact annular conical valve seat 18 when the valve is closed.

Valve seat 18 comprises an annular metallic member which can be inserted into the housing 4 from its lower end. An O-ring seal 28 is located along the exterior of valve seat 18 to provide sealing integrity between the valve housing and the valve seat. An annular elastomeric seal 26 is disposed around the exterior of the lower portion of valve seat 18. Sealing integrity can thus be established along the downwardly facing conical seating surface 18*a* and with the lower end of resilient seal 26. Note that valve seat 18 is held in position by the abutment of an upper surface 18*b* with a downwardly facing shoulder 4*a* located on the eccentric valve housing. In this embodiment of the invention, the valve seat is positioned above the eccentric bore 8 of valve housing 4.

Figure 3:
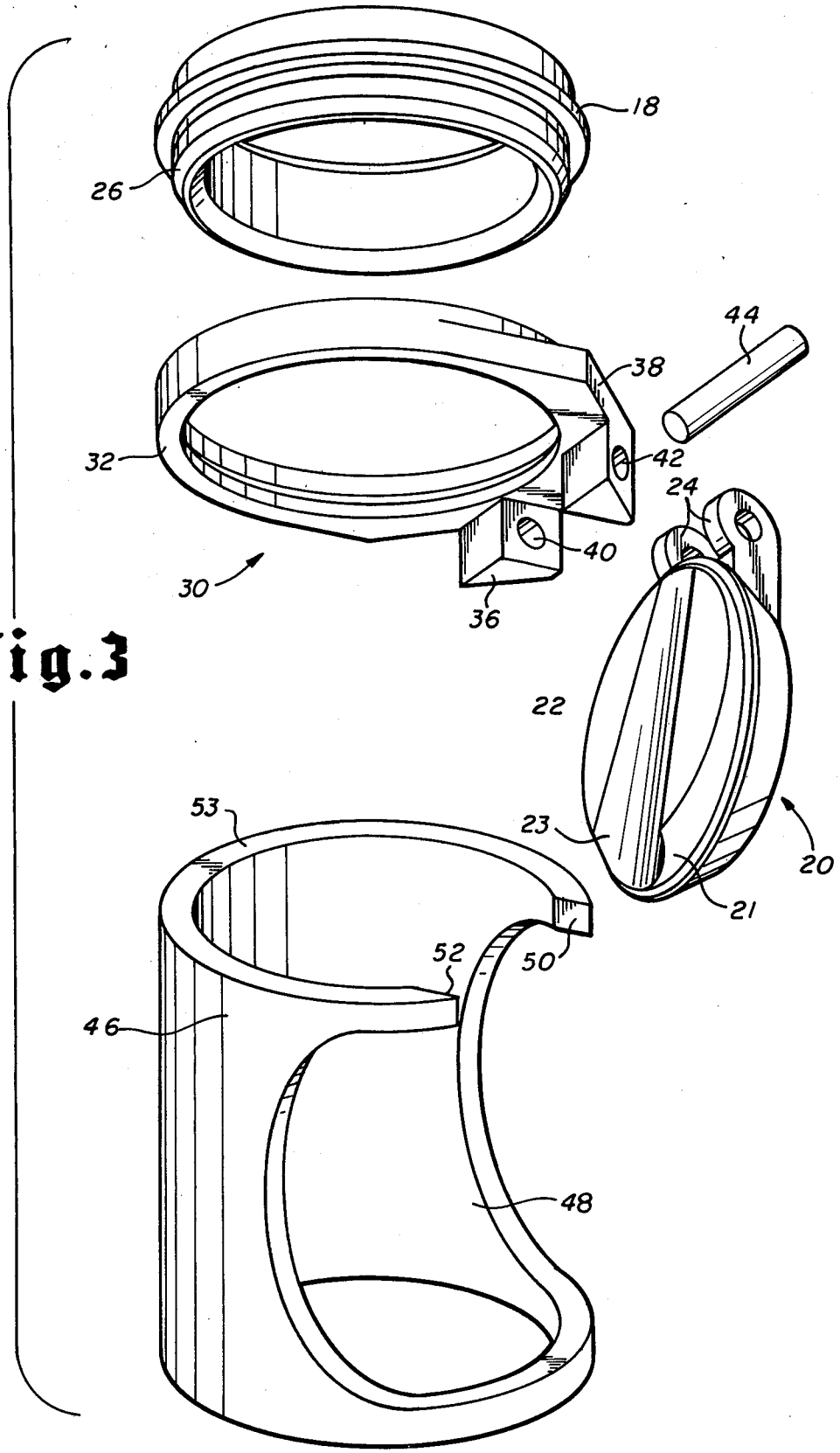
FIG. 3 is an exploded perspective view showing the flapper, the flapper base, the valve seat and the cylindrical support member.

Flapper 20 is mounted on a separate annular flapper base 30 shown in FIG. 3. Flapper base 30 comprises a cylindrical section 32 and an eccentric projecting flange portion 34. Flange 34 has two offset bearings 36 and 38 each of which has aligned sockets 40 and 42 for receipt of hinge pin 44. Note that the diametrically opposed sides of flange 34 are substantially tangential to the exterior of cylindrical section 32.

Figure 4:
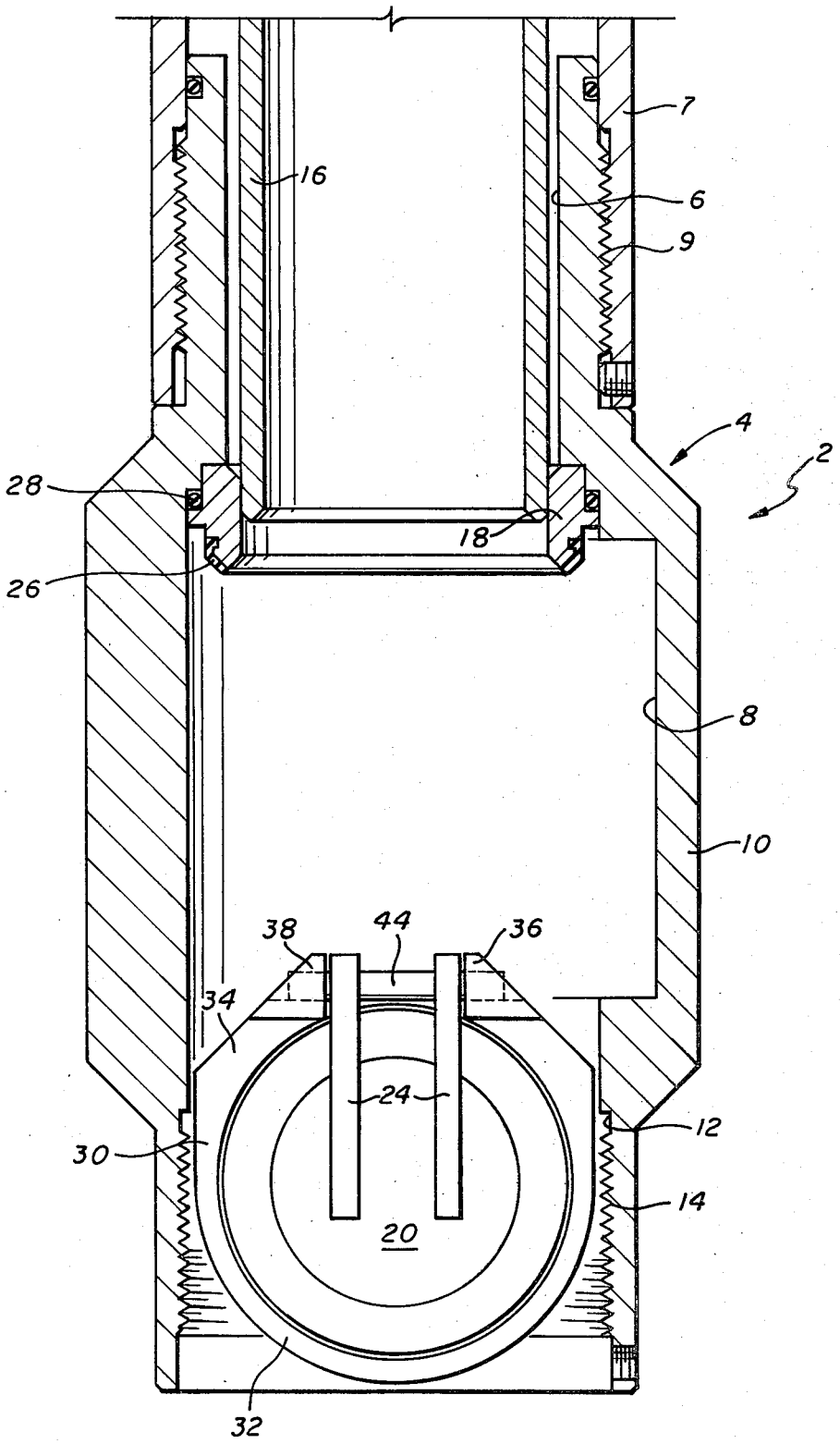
FIG. 4 is a longitudinal section of the valve housing showing the transverse insertion of the flapper base with flapper attached during assembly of the valve.

As shown in FIGS. 1 and 2 flapper base 30 is positioned in abutting relationship with valve seat 18 in the assembled configuration of this valve. Flapper base 32 with its eccentrically projecting flange 34 is positioned within eccentric bore 8. As shown in FIG. 4 flapper base 30 may be transversely inserted through the lower concentric bore 12 of housing 4. The tangential sides of flange 34 permit insertion of flapper base 30 through the housing with the axis of cylindrical section 32 extending generally perpendicular to the axis of valve housing 4. When the flapper base, with flapper 20 attached has been fully inserted into eccentric bore 8, the flapper base 32 may be rotated into the assembled position of FIGS. 1 and 2.

After insertion of flapper base 30 into the valve housing 4 a cylindrical support sleeve 46 may also be inserted from the lower or upstream side of valve housing 4 through lower concentric bore 12. This valve support member is shown in FIG. 3. Note that cylindrical support sleeve 46 has been rotated to clearly show the cutout section 48 which provides clearance for the opened flapper 20. Adjacent the upper edges of sleeve 26 are two oppositely facing upwardly extending arcuate segments 50 and 52 which abut the offset bearing surface 36 and 38 in the assembled flapper configuration. The upper end 53 of support sleeve 46 also abuts the upstream surface of flapper base 30 to firmly secure the flapper base between support sleeve 46 and valve seat 18. The flapper mechanism is firmly secured in position upon insertion of a lower cylindrical body section 54 which has external threads 58 for engaging the internal threads 14 on the lower section of valve housing 4. When lower body section 54 is fully engaged with valve housing 4 and upper surface 60 provides a lower limit to the travel of actuating sleeve 16. As can be seen in FIG. 2 downward movement of actuating sleeve 16 causes flapper 20 to rotate to its fully open position at which time actuating sleeve 16 can extend through the arcuate recess 23 and the upper surface of flapper 30. The lower end of actuating sleeve 16 thus abuts limit surface 60 and covers the sealing surfaces of the flapper mechanism while the valve is in the open configuration.

Although the invention has been described in terms of the specified embodiment which is set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A flapper type valve for a subterranean well comprising, in combination: a tubular conduit, means on said tubular conduit defining a downwardly facing, annular conical valve seat; a flapper valve having an annular conical surface cooperable with said valve seat in sealing relation; pivot means on one side of said tubular conduit for mounting said flapper valve to said conduit to permit downward pivotal movement of said flapper valve away from said valve seat to a vertical open position; resilient means urging said flapper valve upwardly to its closed sealing position; a valve actuating sleeve disposed in said tubular conduit, means for moving said actuating sleeve downwardly to engage and open said flapper valve; and elevated top surface on that portion of said flapper valve remote from said pivot means for initially engaging the bottom face of said actuating sleeve to initiate opening movement of said flapper valve; and an arcuate cylindrical recess of the same diameter as the exterior of said actuating sleeve, extending through said elevated surface and said annular conical surface, and being positioned to receive the exterior of said actuating sleeve when said flapper valve is shifted downwardly by said sleeve to its vertical open position, wherein said elevated surface on said flapper valve comprises a planar surface inclined relative to a radial plane of said actuating sleeve, said planar surface being sloped upwardly away from said pivotal means, and wherein the inclination of said annular conical surfcae cooperable with said valve seat relative to said radial plane is greater than the angle of inclination of said elevated surface relative to said radial plane, and wherein initial contact between said actuating sleeve and said flapper valve during downward movement of said actuating sleeve on said annular conical surface.

2. A flapper type well control valve for opening and closing a subterranean tubular fluid transmission conduit comprising in combination: a tubular housing having an eccentric bore, a longitudinally movable cylindrical actuating sleeve; a downwardly facing, annular conical valve seat, a generally cylindrical flapper base abutting the upstream side of said valve seat; an eccentric projecting flange on said flapper base for pivotally mounting a flapper type valve closure member; cylindrical support means attachable to said tubular housing base and engaging said flapper base to secure said flapper base and said valve seat in said tubular housing, the width of said flange being no greater than the external diameter of the generally cylindrical flapper base, and a circular valve closure flapper having an annular peripheral conical surface cooperable with said valve seat and an elevated top surface on that portion of the flapper remote from pivotal mounting means for initial engagement with said actuating sleeve to initiate opening movement of said flapper upon longitudinal movement of said actuating sleeve.

3. A flapper type well control valve for opening and closing a subterranean tubular fluid transmission conduit comprising in combination: a tubular housing having an eccentric bore; a longitudinally movable cylindrical actuating sleeve; a downwardly facing, annular conical valve seat, a generally cylindrical flapper base abutting the upstream side of said valve seat; an eccentric projecting flange on said flapper base for pivotally mounting a flapper type valve closure member; cylindrical support means attachable to said tubular housing base and engaging said flapper base to secure said flapper base and said valve seat in said tubular housing, the width of said flange being no greater than the external diameter of the generally cylindrical flapper base, and a circular valve closure flapper having an annular peripheral conical surface cooperable with said valve seat and an elevated top surface on that portion of the flapper remote from pivotal mounting means for initial engagement with said actuating sleeve to initiate opening movement of said flapper upon longitudinal movement of said elevated surface and said annular conical surface, positioned to receive said actuating sleeve when said flapper is rotated to its open position by longitudinal movement of said actuating sleeve.

4. A well control valve for opening and closing a subterranean tubular fluid transmission conduit and comprising a circular flapper movable from a closed to an open position in response to longitudinal movement of a cylindrical actuating member; the improvement comprising: a tubular housing member having an eccentric bore with an internal diameter greater than the external diameter of said actuating member; an annular flapper base; means for pivotally attaching said flapper to said flapper base; a valve seat member having an annular surface cooperable with said flapper base downstream of said flapper; and cylindrical support means attachable to said tubular housing upstream of said flapper and engaging the upstream side of said flapper base to secure said flapper and said valve seat in said tubular housing wherein said flapper base comprises a cylindrical section having a projecting flange extending radially from one side thereof, said attaching means being mounted on said base; the width of said flange being no greater than the external diameter of said cylindrical section whereby said flapper base can be initially inserted through said tubular housing with the axis thereof transverse to the axis of said tubular housing and rotated within said eccentric bore to align the axis of said flapper base with the axis of said tubular housing.

5. The well control valve of claim 4 wherein said means for pivotally attaching said flapper to said flapper base comprises a hinge pin extending through at least one hinge bracket on said flapper.

6. The well control valve of claim 5 wherein said flange comprises axially offset socket means for receiving said hinge pin.

7. The well control valve of claim 6 wherein said hinge pin extends through two spaced brackets on said flapper and to spaced sockets on said flapper base, with the brackets being located between and adjacent one of said sockets.

8. The well control valve of claim 4 wherein said tubular housing has a concentric bore longitudinally adjacent said eccentric bore, the diameter of said concentric bore being less than the diameter of said eccentric bore and greater than the external diameter of said flapper base cylindrical section to permit insertion of said flapper base therethrough.

9. The well control valve of claim 8 wherein said cylindrical support means is attachable to threads on said concentric housing bore upstream of said flapper.

10. The well control valve of claim 9 wherein said cylindrical support means comprises first and second tubular members, said first tubular member being threaded for attachment to said concentric bore and said second tubular member being positioned in abutting relationship between said threaded first tubular member and said flapper base.

11. The well control valve of claim 10 wherein said second tubular member has an opening extending transversely therethrough for receipt of said flapper in the open position.

12. A well control valve for opening and closing a subterranean tubular fluid transmission conduit and comprising a circular flapper movable from a closed to an open position in response to longitudinal movement of a cylindrical actuating member, the improvement comprising: a tubular member having an eccentric bore with an internal diameter greater than the diameter of said circular flapper; an annular flapper base having means for pivotally attaching said flapper to said flapper base, said flapper base being transverse to the axis of said tubular housing and rotatable within said eccentric bore to align the axis of said flapper base with the axis of said tubular housing; and support means attached to said tubular housing to secure said flapper base and said flapper in the eccentric bore of said tubular housing wherein said flapper base comprises a cylindrical section having a projecting flange extending radially from one side thereof, said attaching means being mounted on said base, and wherein the width of said flange is no greater than the external diameter of said cylindrical section.

13. The well control valve of claim 12 wherein said tubular housing has a concentric bore downstream of said eccentric bore.

14. The well control valve of claim 13 wherein the external diameter of said flapper base is less than the internal diameter of said concentric bore to permit insertion of said flapper base therethrough.

15. The well control valve of claim 14 wherein said support means threadably engages said tubular housing within said concentric bore.

16. The well control of claim 15 wherein the external dimension of said flapper base perpendicular to the width of said flange and perpendicular to the flapper base axis is greater than the internal diameter of said concentric bore and less than the diameter of said eccentric bore.

17. The well control valve of claim 12 wherein the diametrically opposed sides of said flange extends tangential to the exterior of said cylindrical section.

* * * * *